United States Patent [19]

Perovich

[11] Patent Number: 4,582,573

[45] Date of Patent: Apr. 15, 1986

[54] METHOD FOR TREATING A SINGLE SIDE OF A METALLIC SHEET

[75] Inventor: Paul C. Perovich, Trenton, Mich.

[73] Assignee: Comet Research, Inc., Trenton, Mich.

[21] Appl. No.: 704,783

[22] Filed: Feb. 25, 1985

[51] Int. Cl.[4] ..... C25D 5/02; C25D 7/06

[52] U.S. Cl. ..... 204/15; 204/28

[58] Field of Search ..... 204/15, 28

[56] References Cited

U.S. PATENT DOCUMENTS 3,697,399 10/1972 Usui ..... 204/28

FOREIGN PATENT DOCUMENTS 119226 10/1978 Japan ..... 204/15

23092 2/1982 Japan ..... 204/15

1448585 9/1976 United Kingdom ..... 204/15

*Primary Examiner*—T. M. Tufariello

*Attorney, Agent, or Firm*—Hauke and Patalidis

[57] ABSTRACT

A method for treating a single side surface of a metallic strip by applying two strips back to back with an insert disposed between the strips in engagement with the back surfaces of the strips for preventing introduction of the treatment solution between the strips. The insert may be a magnetic pliable band in arrangements where the metallic strips are magnetizable, or it may be non-magnetic and provided with adhesive on its surfaces in engagement with the strip backs, or it may be held between the strips under pressure being applied to the strips forcing them toward each other.

19 Claims, 15 Drawing Figures

METHOD FOR TREATING A SINGLE SIDE OF A METALLIC SHEET

CROSS-REFERENCE TO RELATED APPLICATION

This application is related to co-application Ser. No. 704,743, filed contemporaneously herewith and assigned to the same assignee as the present application.

BACKGROUND OF THE INVENTION

The present invention relates to a method for treating a single side surface of a metallic sheet, such as a steel sheet, for example, leaving the surface of the other side of the sheet untreated.

There is a demand for supplying steel sheet, for example, with a single side surface having been subjected to an appropriate treatment such as applying to a single side surface a coating of zinc or zinc alloy, or a coating of tin, lead, or other dissimilar metal or alloy. For example, sheet steel galvanized on one surface only presents many advantages in the automobile and appliance industry where it is desired to paint the non-treated surface and leave the treated surface intact to resist corrosion, as it is difficult to obtain a good and smooth painted surface over an anti-corrosion coating of zinc or zinc alloy, for example.

Diverse methods have been proposed in the past for, for example, galvanizing only one surface of a steel sheet such as by welding two steel strips back-to-back at their edge, or by crimping the edges, so as to form a sandwich or laminate which is subjected to an appropriate treatment, such as zinc or zinc alloy hot dipping or electrolytic plating. The edge weld or crimping prevents the molten metal or metal alloy, or the electrolyte, from penetrating between the two sandwiched or laminated strips, with the result that only one surface, the exterior surface of each strip is plated. After treatment, the two strips are separated, generally by shearing off the edges of the sandwiched or laminated strips.

The inconveniences of welding two steel strips back-to-back at their edges are that the heat of welding has a pronounced effect on the metallurgy of the steel, and there is a considerable loss of material resulting from the edge shearing. Another inconvenience resulting from forming a sandwich or laminate of two metallic strips by edge crimping is that the crimp may not provide an effective dam preventing molten metal, or electrolyte, from seeping through the crimp and may cause irregular and random seepage through the edge crimp, thus coating or plating a portion of the surfaces which it is desired to protect.

SUMMARY OF THE INVENTION

The present invention remedies the inconveniences of the prior art by providing a method enabling to momentarily unite back to back two strips of sheet steel, or other metallic strips, and forming an effective dam preventing the electrolyte during electrolytic plating operation or a chemical solution during a chemical treatment operation from penetrating between the sandwiched or laminated strips. The method of the invention has applications more particularly to electroplating, such as galvanizing, as well as to other electrolytic or chemical treatments of the exposed surfaces of the sandwiched or laminated strips.

The diverse objects and advantages of the present invention will become apparent to those skilled in the art when the following description of an example of the best mode contemplated for practicing the invention is read in conjunction with the accompanying drawing wherein:

DETAILED DESCRIPTION OF THE PREFERRED EMBODIMENTS

Figure 1:
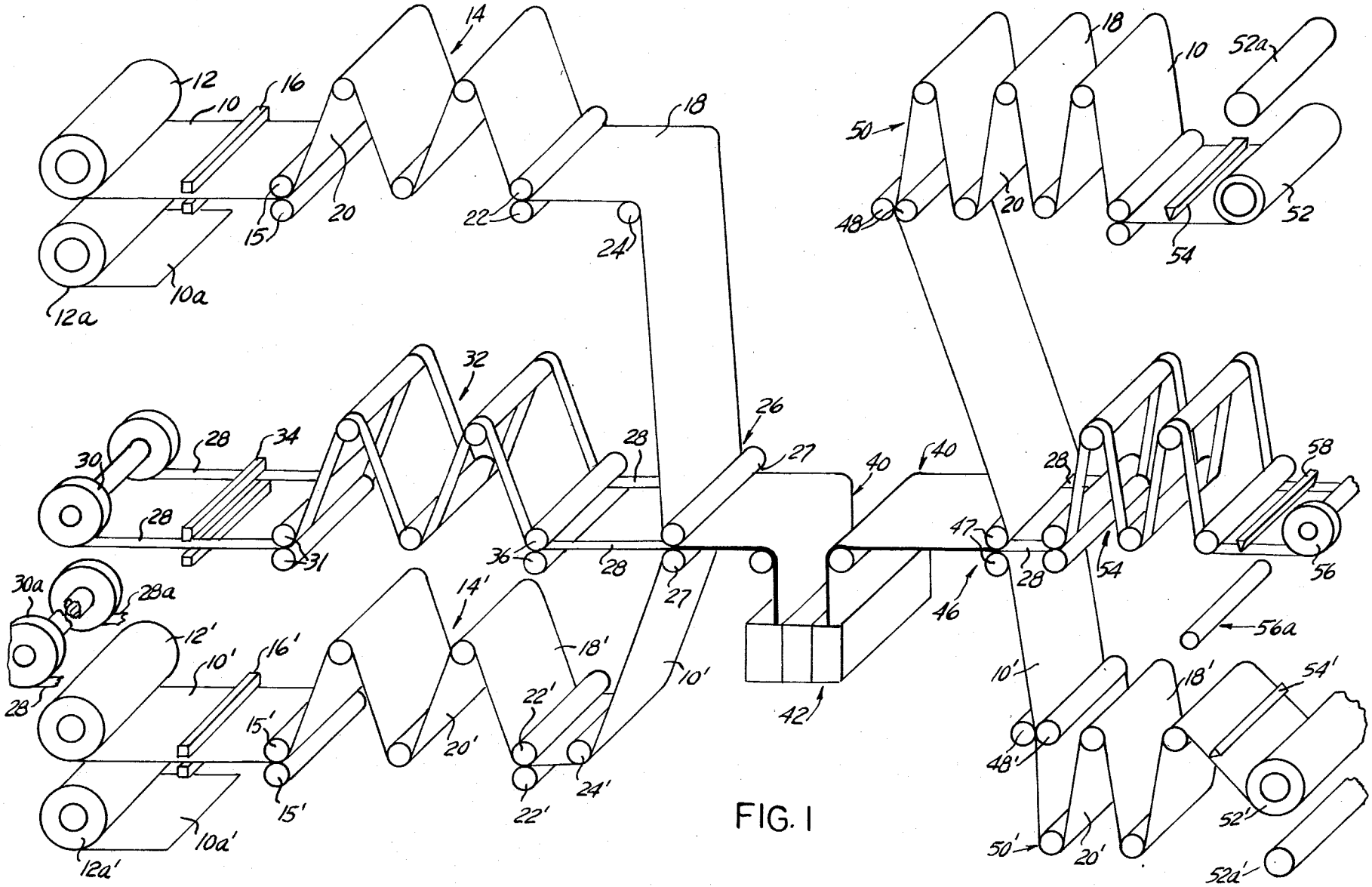
FIG. 1 is a schematic representation of a continuous line metallic strip treatment operation according to the present invention.

Referring to FIG. 1 of the drawing, there is illustrated, schematically, an example of a continuous metallic strip treatment line according to the present invention. A first strip 10 of steel, for example, or other metallic sheet material is uncoiled from a coil roll 12 and fed through an accumulator 14 by appropriate drive pinch rollers or drums 15. A strip butt-welder 16 is provided between the coil roll 12 and the drive pinch rollers 15 such as to make the process continuous by butt-welding the trailing edge of the strip 10 with the leading edge of a strip **10*a* uncoiled from a coil roll 12*a* when the coil roll 12 is exhausted. The accumulator 14 permits the process to be continuous during the butt-welding operation of the leading edge of a new strip with the trailing edge of the strip 10, strip material from the accumulator 14 being continuously fed forward by an appropriate feeding means, such as, for example, a pair of drive pinch rollers 22**.

A second strip 10' of steel, for example, is uncoiled from a coil roll 12' and fed by drive pinch rollers 15' to an accumulator 14'. A butt-welder 16' is disposed between the coil roll 12' and the accumulator 14', such that the feeding of the strip 10' is continuous, a strip **10*a*' being obtained from a coil 12*a*' when the coil 12'** is exhausted.

The arrangement illustrated at FIG. 1 permits to treat, such as to plate for example, the upper surface 18 of the strip 10 and to protect from plating the lower surface 20 of the strip 10, and to plate the lower surface 20' of the strip 10', while protecting the upper surface 18' of the strip 10'. The strip 10 is fed from the accumulator 14 by the pair of drive pinch rollers 22 over a guide roller 24 while, simultaneously, the strip 10' is fed from the accumulator 14' by means of, for example, a pair of pinch drive rollers 22' under a guide roller 24', to a sandwiching station 26 taking the form of a pair of drive pinch rollers 27. A pair of parallely disposed edge insert strips or ribbons 28 are fed between the strips 10 and 10' at the sandwiching station 26. The insert strips 28 are made, according to a specific embodiment of the invention, of pliable material such as an elastomeric or other appropriate pliable and flexible synthetic resin containing a predetermined portion of magnetic particles. The insert strips 28 are similar in composition and structure to the magnetic strips used as door seals and holding means in refrigerators and like appliances. The magnetic insert strips 28 are obtained from twin coils 30 and are fed by drive pinch rollers 31 to an accumulator 32. A junction station 34 is disposed between the twin rollers 20 and the accumulator inlet feed rollers 31, such that when the magnetic insert strips 28 obtained from the twin coil roll 30 are exhausted, the trailing end of the magnetic insert strips 28 may be joined to the leading end of magnetic insert strips **28*a* obtained from a supply twin coil roll 30*a*. The junction station 34 may take the form of a cold cement splicer, or of a hot splicer, according to the type of material used for making the magnetic insert strips 28**.

Figures 2, 3, 4, 5, 6, 7, 8, 9, 10:
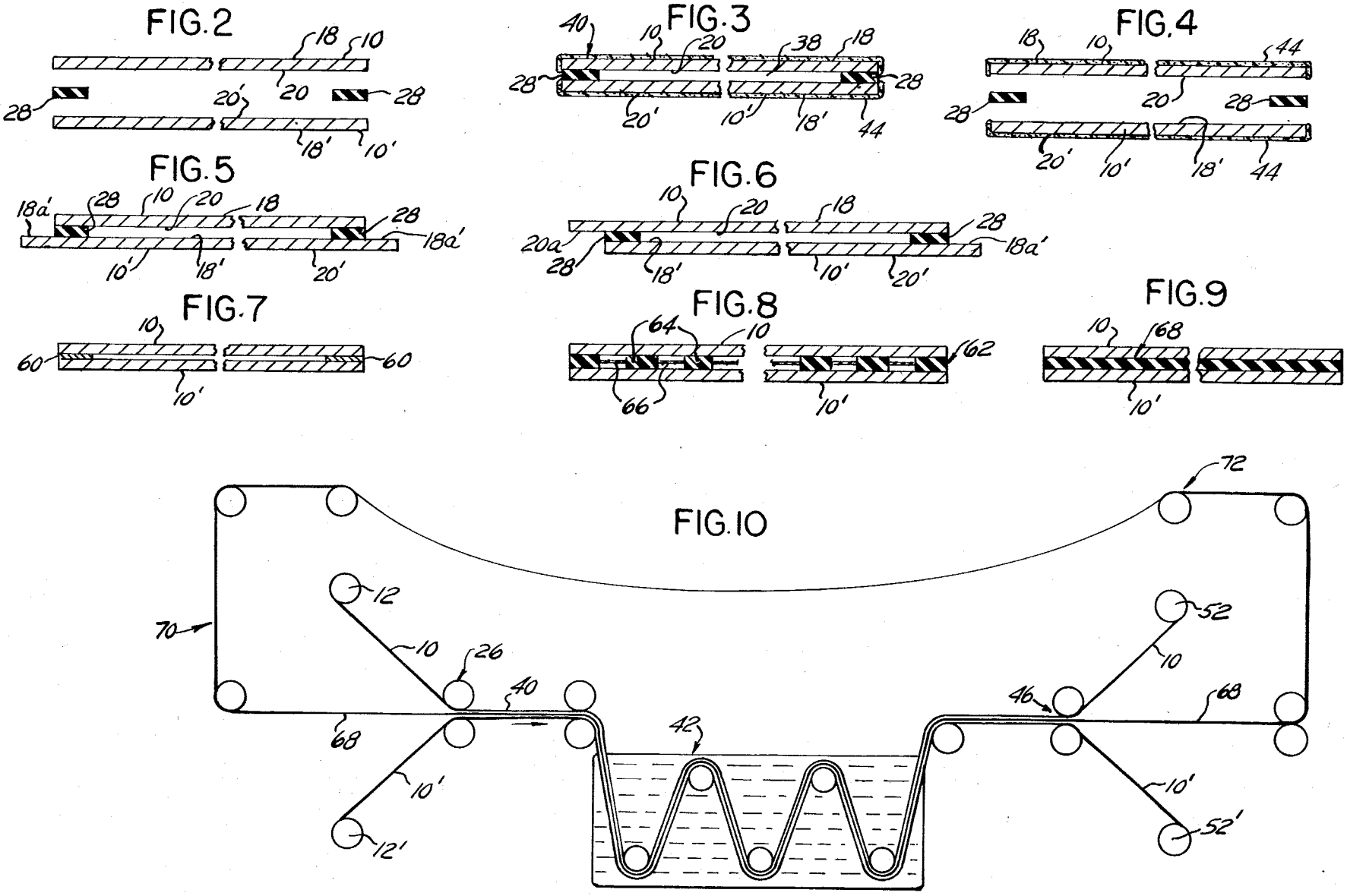
FIGS. 2–4 are transverse sections through the metallic strips at appropriate stages of the process, useful in explaining the principles of the invention.
FIGS. 5–9 are views similar to FIG. 3, and illustrating modifications of the invention.
FIG. 10 is a schematic representation of another example of a continuous line metallic strip treatment according to the present invention.

The magnetic insert strips 28 are fed by appropriate means such as the pinch drive rollers 36, and are held spaced apart by guide members, not shown, such as to be inserted at a sandwiching station 26 between the continuous strips 10 and 10' at, or proximate to each edge of the strips, FIGS. 2 and 3, with the result that, beyond the sandwiching station 26, the strips 10 and 10' are held together back to back, the magnetic insert strips 28 disposed at each edge, or proximate to each edge of the strips causing magnetic attraction between the magnetic insert strips 28 and, respectively, the surfaces 20 and 18' of the steel strips 10 and 10', FIG. 3, and forming a laminated or sandwiched strip 40. It is readily apparent that using pliable elastic magnetic insert strips 28 to hold back to back the strips 10 and 10' has applications only with strips 10 and 10' made of metallic or metallic alloys, such as steel, which are magnetizable.

By using magnetic particles of strong magnetic properties, such as for example magnetic particles of cobalt-rare earth permanent magnet material embedded in an elastomeric binder, to make the magnetic strips or ribbons 28, a strong magnetic bond is effected between the magnetic insert strips 28 and the metallic strips 10 and 10' which, in addition to holding the strips 10 and 10' back to back enables the magnetic insert strips 28 to act as effective dams preventing the introduction of treatment solutions in the narrow space or gap 38, FIG. 3, between the strips 10 and 10', when the sandwiched strip 40 being fed from the sandwiching station 26, FIG. 1, is caused to be dipped into the diverse baths of a treatment station 42. Such diverse baths may be chemical cleaning solutions, and rinsing, pickling, and the like solutions, and, for example, an electrolyte for electrolytic plating of the surfaces 18 and 20 of, respectively, the strips 10 and 10', while protecting the surfaces 20 and 18' from treatment. The electrolytic plating may be of an electrolytically deposited coating of zinc, or other metal or alloy.

After emerging from the treatment station 42 of the line, the strip sandwich 40 is provided on its outer surfaces with a plating 44 of, for example, zinc or zinc alloy, if the selected treatment is electrolytic galvanizing of one side only of the strips 10 and 10', FIG. 3. The plating 44 is thus placed only on the faces 18 and 20' of respectively the strips 10 and 10', the faces 20 and 18' having been insulated against penetration of the treatment solutions and electrolyte by the edge dams formed by the magnetic strips 28.

After emerging from the treatment station 42 of the line, the strip sandwich 40 is fed to a stripping station 46, consisting for example of a pair of free-wheeling pinch rollers 47, where the strips 10 and 10' and the magnetic strips 28 are peeled away from each other and separated. The strip 10, plated on its face 18, is fed by a pair of drive pinch rollers or drums 48 to an accumulator 50, and from the accumulator is wound onto a coil 52. The strip 10', plated or otherwise treated on its face 20' is fed by a pair of drive pinch rollers 48' to an accumulator 50', and from there is wound in a roll 52'. Appropriate shears 54 and 54' are provided for cutting off the strips 10 and 10', respectively, when the coil rolls 52 and 52' are full, such as to permit to remove the coil rolls 52 and 52', and start winding a new coil on drums or rolls **52*a* and 52*a'*. The magnetic strips 28, after passage through an accumulator 54*a*, are wound as twin coil rolls 56 or 56*a*, a cut-off shear 58 being provided to cut off the magnetic strips 28 when a twin coil roll 56** is filled.

As illustrated at FIG. 5, the metallic strips 10 and 10' may be of different width, the strip 10 being shown narrower than the strip 10'. The result is that the strip 10' is plated, or otherwise treated, not only on its surface or face 20', but also around its edges and on marginal portions of its surface or face 18', as shown at **18*a'* between each edge and the location of each magnetic strip 28. Such a result may be advantageous where it is desired to plate the edge of a steel sheet and a small margin on the unplated face of the sheet, to prevent edge corrosion for example. Such a controlled plating, or other treatment of the unplated face of a metallic sheet may be accomplished by using strips 10 and 10' of the same width, and staggering the respective edges of the strips, as shown at FIG. 6. Such an arrangement results in plating, or other treatment, of a single marginal area of the untreated face of the strips 10 and 10'**.

FIG. 7 illustrates an example of a modification of the present invention wherein the magnetic strips or ribbons are replaced by ribbons 60 of plastic tape provided on each side with an appropriate adhesive, such that the strips 10 and 10' are held back to back, with the ribbons 60 of adhesive tape and forming a dam preventing treating solutions from penetrating between the back to back strips. Such an arrangement may be used for treating strips 10 and 10' made of non-magnetic material.

In some operations, it may be desirable to support the strips 10 and 10', when placed back to back, along their full width. This may be done, as illustrated at FIG. 8, by means of a dam insert 62 made of a plurality of individual ribbons 64 which are separate and disposed spaced apart or which, preferably, are interconnected by bridging thinner portions 66, or by a continuous band 68, FIG. 9, of appropriate width, sandwiched between the strips 10 and 10'. The dam insert 62 or 68 may be made of rubber-like material in which high strength magnetic particles are embedded, or of non-magnetic material provided on each face with an adhesive, or a combination of both, or, in the alternative and as described hereinafter, the dam inserts 62 and 68 may simply consist of non-magnetic bands of rubber-like material without adhesive.

When using relatively low cost insert material sandwiched between the strips 10 and 10', after peeling apart of the strips 10 and 10', the insert material, as for example the adhesive tape 60 of FIG. 7, may be discarded. However, relatively costly insert material is advantageously reused as, for example, the magnetic strips or ribbons 28 of FIG. 1, which are continuously rewound on coil rolls 56–56*a*, and substituted for the coil rolls of fresh material 30 and 30*a*. A continuous loop of insert material may also be used, as illustrated schematically at FIG. 10, the continuous loop 70 of insert material taking the form, for illustrative purpose only, of a wide band of rubber-like insert material as illustrated ay 68 at FIG. 9, provided with embedded high strength magnetic particles. As illustrated at FIG. 10, which for the sake of simplification omits the strip accumulators, butt-welders and shears of FIG. 1, the two strips 10 and 10', obtained from respectively the coil rolls 12 and 12', are fed to the sandwiching station 26, where a continuous loop 70 of insert material 68 is introduced between the strips 10 and 10' such as to form a sandwich strip 40 which is subjected to an appropriate treatment in the treating station 42. At the peeling-off station 46 the treated strips 10 and 10' are rewound as coil rolls 52 and 52', while the loop 70 of insert material 69 is continuously fed back by an appropriate feed roller system, or other conveyor system, generally designated at 72, to the input of the line symbolically represented by the sandwiching station 26.

Figures 11, 12, 13, 14, 15:
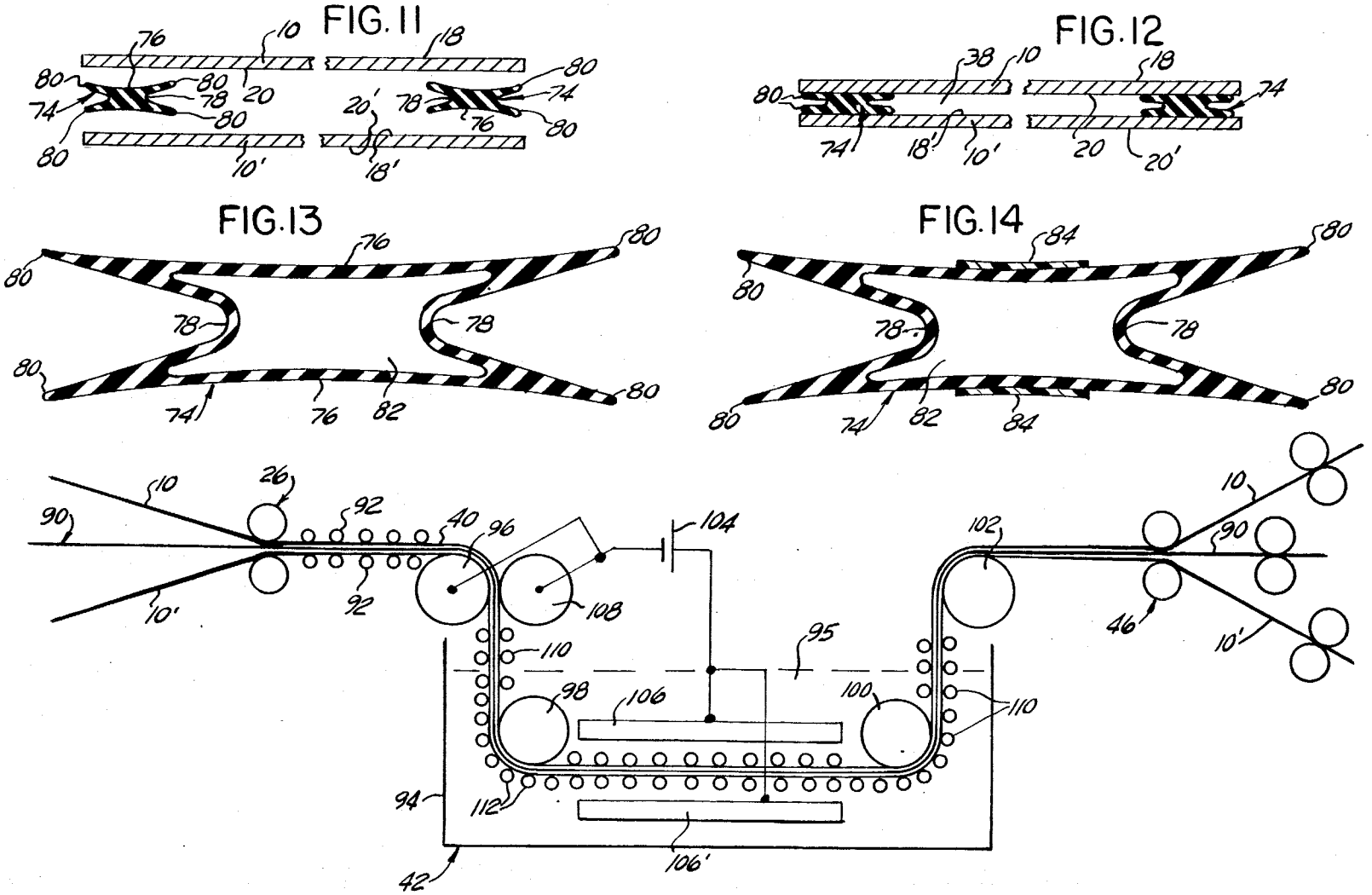
FIGS. 11 and 12 are transverse sections through metallic strips at two different stages in the method of the invention and illustrating a further modification of the invention.
FIG. 13 is a schematic transverse section, at an enlarged scale, of one of the elements illustrated at FIGS. 11–12.
FIG. 14 is a view similar to FIG. 13 but showing a modification thereof.
FIG. 15 is a schematic representation of another example of a process according to the present invention.

FIG. 11 illustrates a further modification of sealing insert members 74 for insertion at each edge or proximate each edge of the strips 10 and 10', such that when the strips 10 and 10' are compressibly held together by appropriate means, as, for example, appropriate rows of pinch rollers, the sealing members 74, FIG. 12, prevent introduction of a treating solution between the back-to-back disposed strips 10 and 10'. The sealing insert members 74 are in the form of generally X-shaped, in cross-section, elongate ribbons or strips made of an elastomeric material, each provided with slightly concave opposite faces 76, in a relaxed state, for engagement with the surfaces 20 and 18', respectively, of the strips 10 and 10'. Each edge of the sealing insert strips 74 is provided with a V-groove 78 forming bifurcated diverging lips 80. When placed between the strips 10 and 10', and squeezed under compression, the concave faces 76 tend to flatten, FIG. 12, and the lips 80 are firmly applied against the surfaces 20 and 18' of the strips 10 and 10', thus preventing introduction of treating solution within the space 38 between the strips. The pressure of the treating solution applied within the edge V-groove 78 exposed to the treating solution tends to more forcefully apply the corresponding lips 80 against the surface of the faces 20 and 18' of the strips 10 and 10', respectively.

The sealing insert strips 74 may be molded in mass as a single piece, or they may be molded hollow, as shown at 82, as illustrated at an enlarged scale at FIG. 13. They may be used as such, with or without magnetic particles embedded in the rubber-like material of which they are molded, or they may be used in combination with a relatively narrow strip of plastic tape 84, shown in grossly exaggerated thickness at FIG. 14, the plastic tape 84 being provided on both faces with an appropriate adhesive.

FIG. 15 illustrates schematically an electrolytic plating operation effected on the metallic strips 10 and 10', a sealing insert, designated generally at 90, being interposed between the strips 10 and 10' for preventing introduction of the electrolyte between the strips and plating of the back-to-back surfaces of the strips. The insert 90 may be in a single piece, or in the form of separate spaced-apart flexible bands sandwiched between the strips 10 and 10' at the sandwiching station 26 at or proximate to, the edges of the metallic strips 10 and 10'. As an example of application, the sealing insert strip 90 is of the non-magnetic type, provided or not with an adhesive on its faces. When using a sealing strip 90 provided with adhesive on its opposite faces, it is convenient to apply pressure on the strips 10 and 10' by means of a plurality of small diameter pinch rollers 92, FIG. 15, placed downstream of the sandwiching station 26, to cause firm adhesion of the insert strip 90 to the back surfaces of the strips 10 and 10' while forming the laminated sandwich strip 40 which is directed, for example and as illustrated, into a treating station 42 consisting of a tank 94 at least partially filled with an appropriate electrolyte 95. Relatively large diameter drums 96, 98, 100 and 102 are provided, around which the sandwich laminated strip 40 is wound for directing the sandwich laminated strip 40 in the electrolyte 95 towards the bottom of the tank 94, the sandwich laminated strip 40 being caused to travel preferably in a straight line between the large diameter rollers or drums 98 and 100, disposed proximate the bottom of the tank 94.

A DC power supply 104 has its positive terminal connected to appropriate anodes in the form of metallic plates 106 and 106' disposed in the electrolyte 95 proximate respectively the face 18 of the metallic strip 10 and the face 20' of the metallic strip 10' to be plated, in the straight section of travel of the sandwich laminated strip 40 in the tank 94 of electrolyte 95. The negative terminal of the DC power supply 104 is connected to the metallic strips 10 and 10' via the drum 96, which is current conductive, and a second current conductive roller or drum 108, the drum or roller 108 being mechanically arranged relative to the drum 96 such as to act as a pinch roller in conjunction therewith. In arrangements wherein the insert 90 is devoid of adhesive on its surfaces, or is provided with a relatively weak adhesive, a plurality of pinch roller pairs 110 are disposed on each side of the sandwich laminated strip 40 at each straight portion thereof between consecutive large rollers or drums 96, 98, 100 and 102, as shown. Where the sandwich laminated strip 40 wraps around a 90°-arc about the periphery of the rollers or drums 98 and 100, a plurality of small diameter rollers 112 are provided such as to firmly maintain the pressure tending to draw the metallic strips 10 and 10' towards each other, thus firmly squeezing the insert 90 and preventing introduction of the electrolyte 95 between the metallic strips 10 and 10'.

Preferably, the peripheral surface of the pinch rollers 92, 110 and 112 is provided with an elastomeric coating, or the rollers are made of an elastomeric material. The pinch rollers 110 and 112 are longitudinally spaced apart such that metallic ions are able to reach the exposed surfaces of the metallic strips 10 and 10' while in the electrolytic bath 95, and such as to not interfere with the electrolytic deposition action. After emerging from the electrolytic bath 95, the metallic strip 10 and 10', plated on a single surface only, for example their surfaces 18 and 20' exposed to the electrolytic action, are peeled apart and from the insert 90 at the stripping station 46. The insert 90 may form a continuous loop as in the arrangement of FIG. 10.

When using non-magnetic dam inserts, the surfaces of the inserts in engagement with the back surfaces 20 and 18' of the strips 10 and 10', respectively, may be coated with a mill bond or ram draw solution which improves the quality of the seal between the surfaces of the inserts and the back faces 20 and 18' of the strips 10 and 10', respectively. Materials such as mill bond and ram draw solutions are used as drawing die lubricants, and they may be left on the surface of the strips or, if so desired, removed by washing through an alkaline solution. Both are impervious to acid solutions.

It will be appreciated that the invention permits to effectuate a multitude of operations or treatments applied to a single surface of metallic sheets, such as electrolytical galvanizing, or plating with diverse metals or metal alloys, paint spraying, coating or dipping, and the like, where it is desired to treat only a single surface of a metallic strip.

Having thus disclosed the present invention, by way of examples of practical applications, given for illustrative purpose only, what is claimed as new is as follows:

1. A method for exposing to a treatment operation a single surface of a sheet of material, said method comprising placing a pair of said sheets of said material in engagement with a pair of relatively narrow substantially parallel strips made of pliable and flexible material disposed between said sheets each proximate an edge of said sheets and sandwiched between said sheets, and forming a surface seal between said strips and said sheets for preventing introduction of a treating solution between said sheets beyond said strips.

2. The method of claim 1 wherein said sheets are metallic and said strips are each a length of pliable flexible magnetic material.

3. The method of claim 2 further comprising the step of applying pressure on said sheets for squeezing said strips between said sheets.

4. The method of claim 3 wherein said treatment operation is electrolytic plating of a surface of said sheets.

5. The method of claim 3 wherein each of said strips forms a continuous loop and is continuously reinserted between said sheets prior to subjecting said sheets to said treatment operation.

6. The method of claim 2 wherein said treatment operation is electrolytic plating of a surface of said sheets.

7. The method of claim 2 wherein each of said strips forms a continuous loop and is continuously reinserted between said metallic sheets prior to subjecting said metallic sheets to said treatment operation.

8. The method of claim 1 wherein said strips are each a length of pliable material having an adhesive on each surface thereof in engagement with a corresponding surface of each of said sheets.

9. The method of claim 8 wherein said sheets are metallic and said treatment operation is electrolytic plating of a surface of said sheets.

10. The method of claim 8 wherein each of said strips forms a continuous loop and is continuously reinserted between said sheets prior to subjecting said sheets to said treatment operation.

11. The method of claim 8 further comprising the step of applying pressure on said sheets for squeezing said strips between said sheets.

12. The method of claim 1 further comprising the step of applying pressure on said sheets for squeezing said strips between said sheets.

13. The method of claim 12 wherein said sheets are metallic and said treatment operation is electrolytic plating of a surface of said sheets.

14. The method of claim 12 wherein each of said strips forms a continuous loop and is continuously reinserted between said sheets prior to subjecting said sheets to said treatment operation.

15. The method of claim 1 wherein said sheets are metallic and said treatment operation is electrolytic plating of a surface of said sheets.

16. The method of claim 1 wherein said relatively narrow strips are each in the form of a compressible sealing member having a pair of opposite concave surfaces for engagement with said sheets and a longitudinal groove in an edge thereof forming a pair of sealing lips each disposed proximate an edge of said sheets.

17. The method of claim 1 wherein one of said sheets is narrower than the other and each of said strips extends proximate each edge of the narrower of said sheets and leaves exposed to said treatment a marginal portion of the wider of said sheets.

18. The method of claim 1 wherein said sheets are of substantially equal width and are disposed back to back in a staggered position with said strips therebetween such as to leave exposed to said treatment a marginal portion of each of said sheets.

19. The method of claim 1 wherein each of said strips forms a continuous loop and is continuously reinserted between said sheets prior to subjecting said sheets to said treatment operation.

* * * * *

UNITED STATES PATENT AND TRADEMARK OFFICE

CERTIFICATE OF CORRECTION

PATENT NO. : 4,582,573

DATED : 4/15/86

INVENTOR(S) : Paul C. Perovich

It is certified that error appears in the above-identified patent and that said Letters Patent are hereby corrected as shown below:

Col. 4, line 44 after "tape" insert --acting as a means for holding the strips 10 and 10' back to back--;

Col. 5, line 8, change "ay" to --at--;

Col. 5, line 20, change "69" to --68--.

Signed and Sealed this

*Thirtieth* Day of *September 1986*

[SEAL]

*Attest:*

DONALD J. QUIGG

*Attesting Officer*

*Commissioner of Patents and Trademarks*